United States Patent [19]

Kerber et al.

[11] 4,199,134

[45] Apr. 22, 1980

[54] PORTABLE WINCH

[75] Inventors: Francis L. Kerber, St. Louis; George E. Durbin, Chesterfield, both of Mo.

[73] Assignee: Seven-Eleven Patents, Inc., St. Louis, Mo.

[21] Appl. No.: 963,007

[22] Filed: Nov. 22, 1978

[51] Int. Cl.[2] ..... B66D 3/02

[52] U.S. Cl. ..... 254/164; 254/186 HC

[58] Field of Search ..... 254/163, 164, 167, 186 HC; 74/142, 144, 148-152, 154, 155

[56] References Cited

U.S. PATENT DOCUMENTS

| | | | |
|---|---|---|---|
| 3,648,978 | 3/1972 | Ratcliff | 254/186 HC X |
| 3,727,886 | 4/1973 | Cain | 254/167 X |
| 3,985,342 | 10/1976 | Denman | 254/167 X |

*Primary Examiner*—John M. Jillions

*Attorney, Agent, or Firm*—Cohn, Powell & Hind

[57] ABSTRACT

A portable winch having a drum and ratchet wheel mounted upon a frame for rotation about an axis, and a hand lever pivoted upon the frame for rotation about the axis. A tension-transmitting cable is wound upon the drum, and a releasable stop pawl is pivotally mounted upon the frame and engages the ratchet wheel for permitting unidirectional rotation of the drum. A ratchet dog is pivoted upon the hand lever for movement between an operative position engageable with the ratchet wheel and an inoperative position clearing the rachet wheel during pivoting of the hand lever about the axis. A coil spring is fixed to the hand lever and extends transversely of the dog projection, the coil spring selectively engaging one side of the dog projection for biasing the ratchet dog into the operative position, and selectively engaging the opposite side of the dog projection for biasing the ratchet dog into the inoperative position.

7 Claims, 5 Drawing Figures

PORTABLE WINCH

BACKGROUND OF THE INVENTION

In portable winch units of this general type, the ratchet wheel dog mounted on the hand lever is selectively positioned between ratchet wheel engaging and clearing positions, and must be positively maintained in such positions. A variety of operating mechanisms have been developed for positioning the ratchet dog. For example, in one such mechanism, a tension spring is slidably positionable with respect to the pivot point of the ratchet dog to selectively permit the spring to impose a biasing force on the ratchet dog, causing the dog to be pivoted in opposite directions. With this mechanism, there is a likelihood of pinching when the coil spring is shifted.

Still another mechanism provides a separate, pivoted spring-shifter plate mounted adjacent the dog to shift the spring end within the dog slot between two operative positions. While this separate spring-shifter plate avoids contact with the spring end and avoids the hazard of pinching, this spring-shifter plate presents another component part of the mechanism that complicates the structural arrangement and increases the cost. The spring-shifter plate must be positioned necessarily by a handle that could cause unintentional shifting of the tension spring if brought into contact with another object, and cause unintentional movement of the ratchet dog.

SUMMARY OF THE INVENTION

This invention relates generally to a portable winch, and more particularly to a portable winch in which a spring means such as a coil spring is uniquely utilized to bias the ratchet dog into either the operative or inoperative position.

The portable winch has a drum and ratchet wheel mounted upon a frame for rotation about an axis, and a hand lever pivoted upon the frame for rotation about the axis. A tension-transmitting means such as a flexible cable is wound upon the drum. A releasable stop pawl is pivotally mounted upon the frame and engages the ratchet wheel for permitting unidirectional rotation of the drum. A ratchet dog is pivoted upon the hand lever for movement between an operative position engageable with the ratchet wheel, and an inoperative position clearing the ratchet wheel during pivoting of the hand lever about the axis. A spring means is fixed to the hand lever and extends transversely of a projection on the ratchet dog, the spring means selectively engaging one side of the dog projection for biasing the ratchet dog into the operative position and selectively engaging the opposite side of the dog projection for biasing the ratchet dog into the inoperative position.

In one aspect of the present operating mechanism the spring means is a coil spring having its opposite ends attached to the hand lever, and placed under longitudinal tension loading. The ratchet dog projection engages the periphery of the coil spring between the opposite spring ends, and resiliently flexes the coil spring.

In one aspect of the present operating mechanism, the projection extends from a body portion of the ratchet dog to provide a crotch at each side of the projection. The coil spring is disposed selectively in either crotch to bias the ratchet dog selectively into either the operative or inoperative position. The ratchet dog projection engages the periphery of the coil spring, and resiliently flexes the coil spring laterally. The coil spring is slidable and rollable over the projection and movable selectively into either of the crotches.

More particularly, in one aspect of the present operating mechanism, the hand lever includes opposed, laterally spaced arms, and the body portion of the ratchet dog extends between and is pivotally connected to the lever arms. The coil spring extends between and has its ends attached to the lever arms, the coil spring being selectively disposed in either of the crotches provided at each side of the dog projection extending from the body portion of the ratchet dog.

DESCRIPTION OF THE PREFERRED EMBODIMENT

Figure 1:
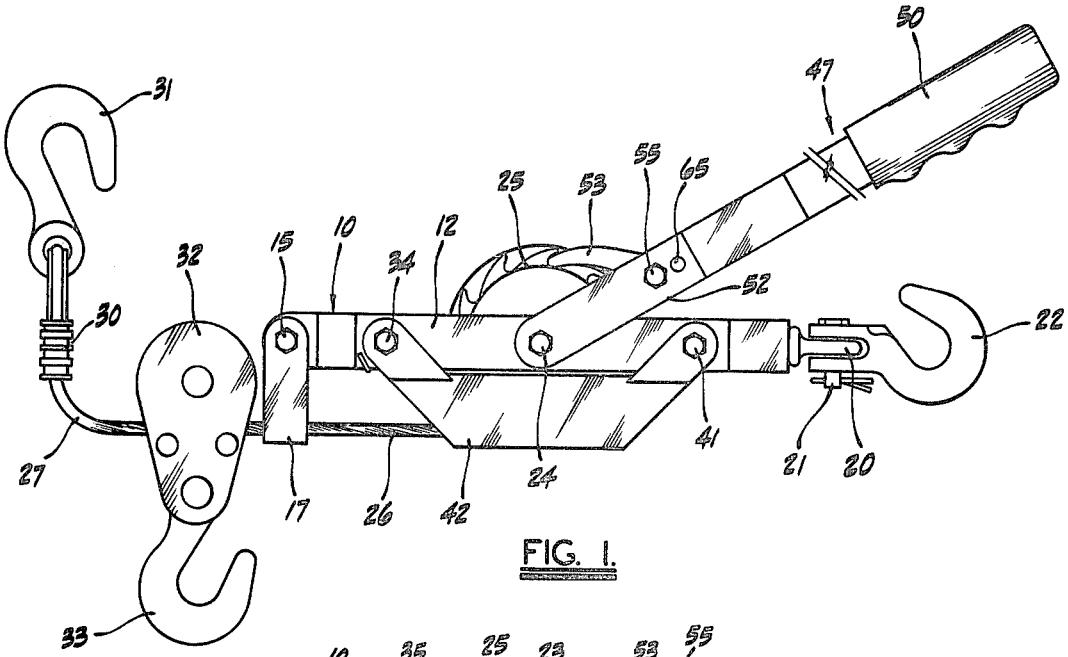
FIG. 1 is a side elevational view of the portable winch.
Figure 2:
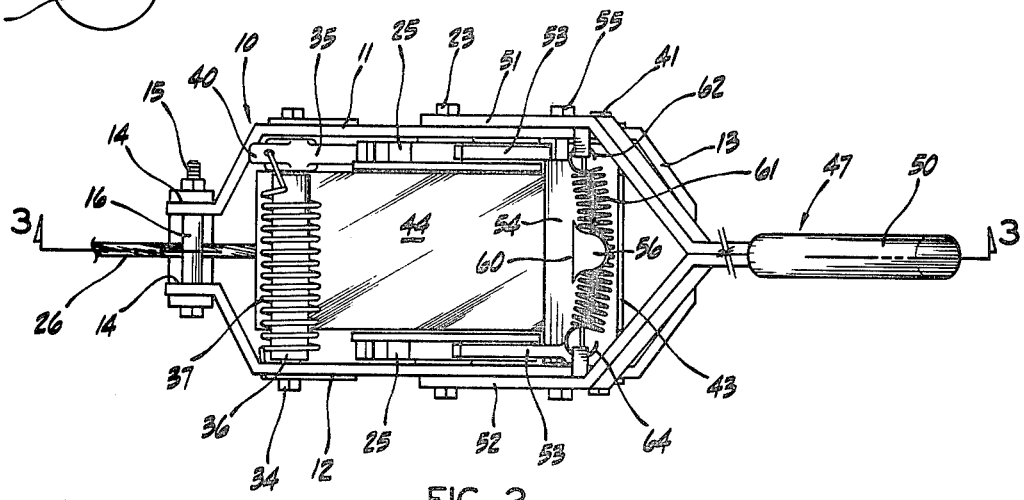
FIG. 2 is a fragmentary top plan view of the winch shown in FIG. 1.

The portable winch includes a main body frame generally indicated by 10 having laterally spaced side frame portions 11 and 12. At one end, these side frame portions 11 and 12 are integrally interconnected by a transverse web frame portion 13. The opposite ends of the side frame portions 11 and 12 are provided with laterally spaced end tabs 14. These tabs 14 are interconnected by a bolt and nut connection 15, and are maintained in a predetermined spaced relationship by a spacer sleeve 16 mounted on the bolt between the end tabs 14.

Figure 3:
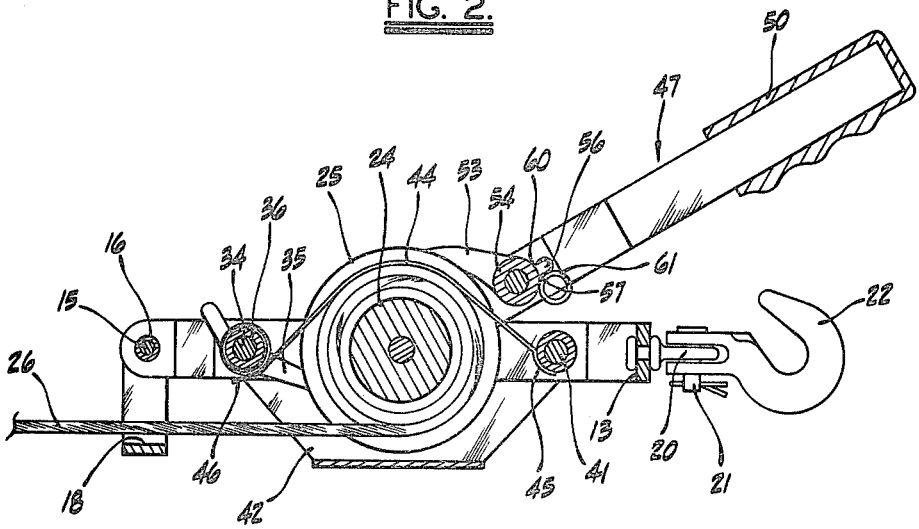
FIG. 3 is a cross-sectional view taken on line 3—3 of FIG. 2.
Figure 4:
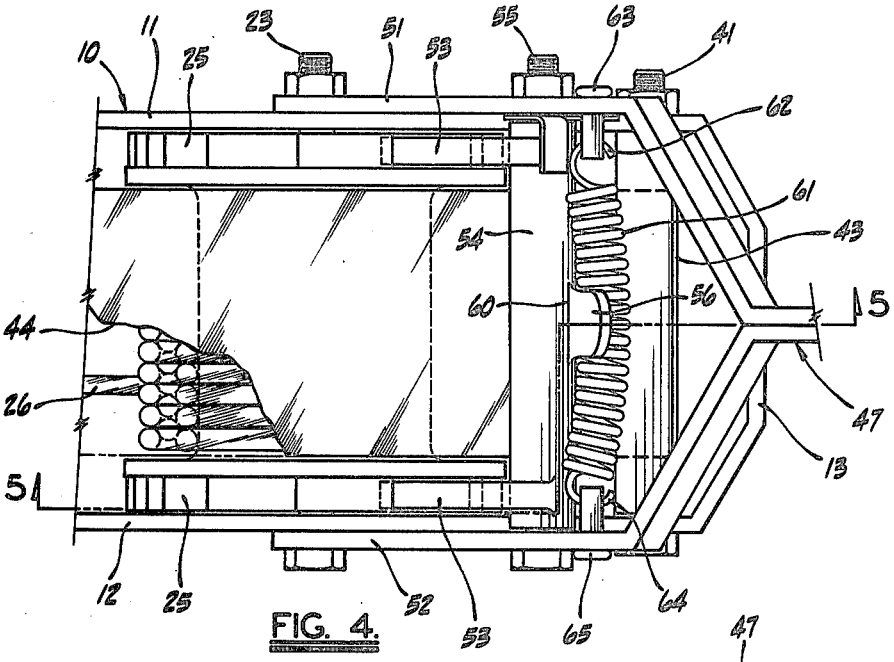
FIG. 4 is an enlarged top plan view of the drum and ratchet wheels, and operating mechanism.

A U-shaped guide bracket 17 is attached to the end tabs 14 by the bolt and nut connection 15, the guide bracket 17 being generally disposed with its web 18 below the main body frame 10 as best seen in FIG. 3.

A swivel eye 20 is attached to the web frame portion 13. Attached by pin 21 to the swivel eye 20, is a hook 22.

Mounted on and between the side frame portions 11 and 12 by an axle 23 which defines a rotative axis, is a drum 24. Attached to each end of the drum 24 and rotatable with the drum 24 on the axle 23, is a ratchet wheel 25. A flexible cable 26, constituting a tension-transmitting means, is fixed to and wound on the drum 24 between the ratchet wheels 25, the cable 26 extending outwardly from the drum 24 and through the guide bracket 17. The outer end 27 of cable 26 is secured by a connector 30 to a hook 31.

As is conventional under certain conditions of use of this general type of winch, a pulley unit 32 can be provided which rides on the cable 26 outwardly of the guide bracket 17. The pulley bracket 32 is provided with a hook 33.

Rotatively mounted on pin 34 extending between the side frame portions 11 and 12, and located closely adjacent the side frame portion 11, is a stop pawl 35 that operatively engages an associated ratchet wheel 25. A sleeve 36 is mounted on the pin 34 between the side frame portion 12 and the stop pawl 35, the sleeve 36 serving as a spacer to hold the stop pawl 35 in position relative to its associated ratchet wheel 25.

A torsion spring 37 is disposed about the sleeve 36, one end of the torsion spring 37 being fixed to the side frame portion 12 and the other end being fixed to a tab 40 on the stop pawl 35. The torsion spring 37 tends to urge the stop pawl 35 resiliently into operative engagement with its associated ratchet wheel 25 to preclude unintentional rotative movement of the drum 24.

Fixed to the side frame portions 11 and 12 by pin 34 and by cooperating pin 41, is a cable housing 42 that underlies the drum 24 and the cable 26 wound on such drum 24 for shielding purposes. Disposed on the pin 41 and extending between the side frame portions 11 and 12, is a spacer sleeve 43. A flexible cover plate 44 is disposed over and engages the upper side of the cable 26 wound on the drum 24 for the purpose of shielding the cable 26. The cover plate 44 is selectively secured in place by one end 45 that underlies and engages the spacer sleeve 43 and by an opposite end 46 that underlies and engages the torsion spring 37 and spacer sleeve 36.

A hand lever referred to by 47 includes a handle 50 and opposed, laterally spaced arms 51 and 52 pivotally mounted respectively to the side frame portions 11 and 12 on the axle 23.

The operating mechanism includes a pair of ratchet dogs 53 integrally connected by an intervening body portion 54. The body portion 54 is located between the spaced lever arms 51 and 52, and is rotatively mounted on a pin 55 extending between and fixed to the lever arms 51 and 52. The ratchet dogs 53 selectively engage the associated ratchet wheels 25.

Figure 5:
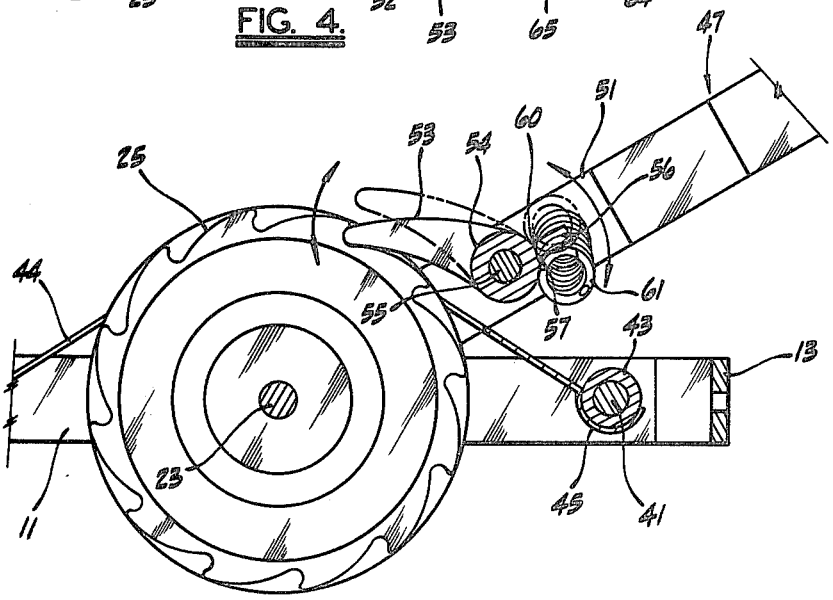
FIG. 5 is a cross-sectional view as taken on staggered line 5—5 of FIG. 4.

Extending from the body portion 54, is a dog projection 56 that cooperates with the body portion 54 to provide crotches 57 and 60 at opposite sides of the dog projection 56 as is best seen in FIGS. 3 and 5.

A coil spring 61, constituting a spring means, extends between the spaced lever arms 51 and 52 and is disposed closely adjacent and transversely of the dog projection 56. One spring end 62 is fixed to the lever arm 51 by a stud 63, and the opposite spring end 64 is fixed to the lever arm 52 by stud 65. Preferably, the coil spring 61, when attached, is under longitudinal tension loading.

The coil spring 61 selectively engages one side of the dog projection 56 for biasing the ratchet dogs 53 into the operative position engageable with the ratchet wheels 25, and selectively engages the opposite side of the dog projection 56 for biasing the ratchet dogs 53 into an inoperative position clearing the ratchet wheels 25 during pivoting of the hand lever 47 about the rotative axis defined by axle 23. More particularly, the coil spring 61 is disposed selectively in either crotch 57 or 60 to bias the ratchet dogs 53 selectively and respectively into either the operative or inoperative position. The dog projection 56 engages the periphery of the coil spring 61, and resiliently flexes the coil spring 61 laterally. The coil spring periphery is slidable and rollable over the dog projection 56 and movable selectively into either of the crotches 57 and 60.

It is thought that the operation of the portable winch is apparent from the foregoing detailed description of the assembly, but for completeness of disclosure, the usage of the winch will be briefly described.

When it is desired that the ratchet dogs 53 operatively engage the ratchet wheels 25, the coil spring 61 is moved over the dog projection 56 and disposed in the crotch 57 so that the coil spring 61 resiliently biases the ratchet dogs 53 into the operative position. With the ratchet dogs 53 maintained in the operative position relative to the ratchet wheels 25, the hand lever 47 will impart a winding rotation to the drum 24 upon counterclockwise rotation of the hand lever 47 as viewed in FIGS. 3 and 5. As the hand lever 47 is returned to initiate another winding "pull", the ratchet dogs 53 will ride over the teeth of the ratchet wheels 25 and yet will remain in engagement because of the biasing force of the coil spring 61.

When it is desired to unreel cable 26 under tension, coil spring 61 must be moved over the dog projection 56 and disposed in the crotch 60 so that ratchet dogs 53 disengage from ratchet wheels 25. Hand lever 47 is rotated counterclockwise to the point where ratchet dog 53 engages stop pawl 35. As hand lever 47 is rotated further counterclockwise, the stop pawl 35 acting through ratchet dog 53, body portion 54 and projection 56 tenses spring coil 61 and forces ratchet dog 53 into engagement with ratchet wheel 25, while ratchet dog 53 acting through stop pawl 35 tenses torsion spring 37 and causes the stop pawl 35 to disengage from ratchet wheel 25. Hand lever 47 is then rotated clockwise, disengaging stop pawl 35 and ratchet dog 53 and allowing drum 24 to turn clockwise. Torsion spring 37 forces stop pawl 35 to reengage the ratchet wheel 25 after the ratchet wheel 25 has moved one notch clockwise. As the hand lever 47 is rotated further clockwise, the spring coil 61 forces the ratchet dog 53 out of engagement with the ratchet wheel 25. The cable 26 can be released in additional one-notch steps by repeating the sequence of operation described above.

When it is desired to permit the drum 24 to freely rotate, as when significant lengths of cable 26 are to be unreeled, the ratchet dogs 53 and the stop pawl 35 must be operatively disengaged from the ratchet wheels 25. The ratchet dogs 53 are cleared from the ratchet wheels 25 by moving the coil spring 61 over the dog projection 56 and disposing the coil spring 61 in the crotch 60. The coil spring 61 then engages the dog projection 56 and resiliently biases the ratchet dogs 53 into the inoperative position. Upon release of the stop pawl 35, the cable 26 may be rapidly unreeled from the drum 24.

When tensioning of the cable 26 is desired, the operator merely slides and rolls the coil spring 61 over the dog projection 56 and again disposes the coil spring 61 in the crotch 57, and rotation of the hand lever 47 will again impart rotation to the drum 24.

We claim as our invention:

1. In a portable winch having a drum and ratchet wheel mounted upon a frame for rotation about an axis, a hand lever pivoted upon the frame for rotation about the axis, tension-transmitting means wound upon the drum, a releasable stop pawl pivotally mounted upon the frame and engaging the ratchet wheel for permitting unidirectional rotation of the drum, the improvement comprising:

(a) a ratchet dog pivoted upon the hand lever for movement between an operative position engageable with the ratchet wheel and an inoperable position clearing the ratchet wheel during the pivoting of the hand lever about the axis, the ratchet dog including a projection, and (b) a spring means fixed to the hand lever and extending transversely of the dog projection, the spring means selectively engaging one side of the dog projection for biasing the ratchet dog into the operative position, and selectively engaging the opposite side of the dog projection for biasing the ratchet dog into the inoperative position.

2. A portable winch as defined in claim 1, in which:
(c) the spring means is a coil spring, the periphery of which engages the dog projection.
3. A portable winch as defined in claim 2, in which:
(d) the projection engages substantially the middle portion of the coil spring, and resiliently flexes the coil spring.
4. A portable winch as defined in claim 2, in which:
(d) the coil spring has opposite ends attached to the hand lever, the coil spring being under longitudinal tension loading, and
(e) the ratchet dog projection engages the periphery of the coil spring between the opposite spring ends, and resiliently flexes the coil spring.
5. A portable winch as defined in claim 2, in which:
(d) the ratchet dog includes a body portion, the projection extending from the body portion to provide a crotch at each side of the projection, and
(e) the coil spring is disposed selectively in either crotch to bias the ratchet dog selectively into either the operative or inoperative position.
6. A portable winch as defined in claim 5, in which:
(f) the ratchet dog projection engages the periphery of the coil spring, and resiliently flexes the coil spring laterally, the coil spring periphery being slidable and rollable over the projection and movable selectively into either of the crotches.
7. A portable winch as defined in claim 2, in which:
(d) the hand lever includes opposed, laterally spaced arms,
(e) the ratchet dog includes a body portion extending between and pivotally connected to the lever arms, the ratchet dog projection extending from the body portion to provide a crotch at each side of the projection,
(f) the coil spring extends between and has its ends attached to the lever arms, the coil spring being selectively disposed in either of the crotches, and
(g) the projection engages the periphery of the coil spring between the spring ends, and resiliently flexes the coil spring, the coil spring biasing the ratchet dog selectively into either the operative or inoperative position.

* * * * *